United States Patent [19]

Gerfast

[11] Patent Number: 4,972,123

[45] Date of Patent: Nov. 20, 1990

[54] POWER-REDUCING CIRCUIT FOR FLUORESCENT AND FOR HIGH-INTENSITY INCANDESCENT LIGHTING FIXTURES

[76] Inventor: Sten R. Gerfast, 1802 Valley Curve Rd., Mendota Heights, Minn. 55118

[21] Appl. No.: 301,730

[22] Filed: Jan. 26, 1989

[51] Int. Cl.[5] ..... H05B 41/16

[52] U.S. Cl. ..... 315/200 R; 315/239; 315/DIG. 5

[58] Field of Search ..... 315/200 R, 239, DIG. 4, 315/DIG. 5

[56] References Cited

U.S. PATENT DOCUMENTS 3,954,316 5/1976 Luchetta ..... 315/228
4,092,565 5/1978 Neal ..... 315/200 R
4,127,797 11/1978 Perper ..... 315/DIG. 5
4,207,497 6/1980 Capewell et al. ..... 315/DIG. 4

*Primary Examiner*—Robert J. Pascal
*Attorney, Agent, or Firm*—Robert E. Granrud

[57] ABSTRACT

An economical power-reducing circuit for either a fluorescent lighting fixture or for a high-intensity, low-voltage incandescent lamp has an electrolytic capacitor and a diode connected in parallel with the capacitor. When used in a fluorescent lamp fixture, the circuit reduces power consumed by the fixture, both when used as a lamp substitute or as an attachment that does not eliminate a lamp. When used with a high-intensity, low-voltage incandescent lamp, the power-reducing circuit eliminates a transformer, thus saving both cost and weight. It also should provide a power saving at no reduction in brightness, and should prolong the life of in the incandescent lamp.

11 Claims, 1 Drawing Sheet

POWER-REDUCING CIRCUIT FOR FLUORESCENT AND FOR HIGH-INTENSITY INCANDESCENT LIGHTING FIXTURES

BACKGROUND OF THE INVENTION

1. Field of the Invention

The invention concerns circuits for reducing the power consumed by fluorescent lighting fixtures and by high-intensity, low-voltage incandescent lighting fixtures By "low-voltage" is meant less than 50 volts. When used with fluorescent lighting fixtures, the power consumed is reduced either by allowing a lamp of a fixture to be removed or by reducing the power consumed by the lamp or lamps of the fixture.

2. Description of Related Art

A high-intensity, low-voltage incandescent lamp which operates from AC household current requires a current-limiting, voltage-reducing circuit, invariably a wound-wire transformer that often draws current when the lamp is turned off. The transformers are expensive, bulky, heavy, and have energy losses associated with the hysteresis and eddy currents in the laminated steel cores of their transformers.

Fluorescent lamps also require current-limiting circuits that are usually called a "ballast", invariably including a wound-wire transformer. Most overhead fluorescent lighting fixtures accept at least one pair of lamps. Currently many of these fixtures are being modified by replacing one of the lamps with a dummy lamp, thus producing nearly 50%. savings in power while reducing the light output 50%. However, the reduction in actual illumination can be much less than 50% by installing a metallized reflective film above the remaining lamp.

Several types of dummy lamps are shown in U.S. Pat. No. 4,107,581. (Abernethy), each having an external appearance similar to that of a conventional fluorescent lamp except that there is no need for air-tight seals between the tubular body and the end caps. In the dummy lamp of FIG. 1, a pin of each end cap is connected to a pin of the other end cap by a wire that is designed to simulate the steady state of a conventional fluorescent lamp. In the dummy lamp of FIG. 2 the two pins of each end cap are interconnected by a resistor "to simulate the resistive effect of the cathode heaters in a conventional rapid start fluorescent lamp" (col. 5, 1s. 2–14). The linear centers of those resistors are in turn interconnected by a wire to simulate the relatively low electrical resistance between the two cathode heaters of a conventional fluorescent lamp.

In the dummy lamp of FIG. 2B which the Abernethy patent says is less preferred than those of FIGS. 1, 2 and 2A, "a capacitor 19*a* which is preferably a relatively large electrolytic capacitor, is coupled in the line 19" between the two resistors 17" and 18".... Several of the drawbacks to using the insert 11" including the capacitor 19*a* include the added expense of the capacitor, the undesirable heat generated in and emanating from the capacitor, a reduced light output level of any remaining fluorescent lamp coupled in the ballast circuit, possible detrimental effects on the remaining components of the ballast circuit, and a possible reduction in life of any such remaining fluorescent lamps" (col. 6, 1s. 10–33).

The dummy lamps of FIGS. 2b and 4 of U.S. Pat. No. 3,956,665 (Westphal) appear to be similar to that of FIG. 2B of the Abernethy patent except that a capacitor is connected directly between one pin at each of its end caps. Although I do not find in the Westphal patent any description of those capacitors except that they should be from 4 to 8 mfd in a replacement for a 40 w lamp in 120 v fixture, they would be inoperative if they were (according to Abernethy's suggestion) electrolytic capacitors. As is pointed out in Grob: "Basic Electronics," McGraw Hill, 5th Ed. (1984) at page 400:

> "If the electrolytic (capacitor) is connected in opposite polarity, the reversed electrolysis forms gas in the capacitor. It becomes hot and may explode. This is a possibility only with electrolytic capacitors."

Dummy lamps like those of FIGS. 2b and 4 of Westphal are currently being marketed as DSI "Phantom" Tube Model PTF 40 by Developmental Sciences, Inc. to replace 40w fluorescent lamps in 120v fixtures. Each of these dummy lamps employs a rolled-film capacitor of about 4 mfd that is about 5 cm long and 3 cm in diameter and is marked with the Westphal patent number.

In the dummy lamp of FIG. 5 of U.S. Pat. No. 4,255,692 (Burgess) "is a conventional capacitor 32 and which is connected to at least one of the terminals 28 and 30 on each of the end caps, respectively, by means of an electrical conductor 34" (para. bridging cols. 7 and 8). Other figures of the Burgess drawing show similarly connected capacitors, but I fail to find in the Burgess patent any description of those capacitors.

U.S. Pat. No. 4,348,614 (Burgess) points out that because of their considerable length, dummy lamps are expensive, both to manufacture and to ship. He obviates this problem by a shortened lamp substitute such as that shown in FIG. 5 which includes a capacitor connected between one pin of an end cap and ground. In FIG. 13, Burgess connects his lamp substitute to socket of a 2-lamp fixture. Except that Burgess says his FIG. 5 uses "a conventional capacitor" (col. 8, line 31), I fail to find any description of the capacitor.

Lamp substitutes similar to FIG. 5 of Burgess '614 have been marketed by Remtec Systems as "No-Watt" Model SP-3-30A and Model SP-350, both containing rolled-film capacitors. The former is marked with U.S. Pats. No. 4,317,069 and 4,475,064.

Instead of a lamp substitute, U.S. Pat. No. 3,954,316 (Luchetta) provides an attachment for a 2-lamp fluorescent fixture that reduces both the power and the light output while illuminating both lamps. Luchetta's attachment 46 of FIG. 1 includes a small isolation transformer 39 and a capacitor 45 connected between the primary and secondary windings 41 and 43 respectively. In the example which employs a nonpolar capacitor of 20 mfd for a 2-lamp, 40 w, 120 v fixture, "the illumination intensity was reduced by 12% with a reduction in input power of 15.6%" (col. 7, 1s. 53–54).

SUMMARY OF THE INVENTION

My invention provides a power-reducing circuit that provides advantages over the prior art when used either with a high-intensity, low-voltage incandescent lamp or when used in a fluorescent lighting fixture.

When used with a high-intensity, low-voltage incandescent lamp, the power-reducing circuit of my invention a) provides savings in cost and weight by eliminating the need for a wire-wound transformer, b) should provide a power saving at no reduction in brightness, and c) should prolong the life of the lamp. Because the novel circuit eliminates a transformer, it draws no power in the stand-by mode. When used with a fluorescent lamp fixture, the power-reducing circuit of my invention should be less expensive, with no offsetting disadvantage, as compared to any prior power-reducing circuit of which I am aware. When used with a fluorescent lamp fixture, the novel power-reducing circuit can be employed either as a lamp substitute or as an attachment that does not eliminate a lamp. In either use, the novel power-reducing circuit is easy to install and should outlast the fluorescent fixture.

Briefly, the power-reducing circuit of my invention consists essentially of an electrolytic capacitor, a diode connected in parallel with the capacitor, and connecting leads.

When used with a high-intensity, low-voltage incandescent lamp, the power-reducing circuit of my invention should be used in pairs, but two such circuits should be much less expensive than is a wire-wound transformer. The capacitance of the two electrolytic capacitors is governed by the rated voltage of the incandescent lamp. For example, each of the electrolytic capacitors should be 100 mfd when used with a 13.8-volt lamp at 120 v, 60 cycles AC.

When the novel power-reducing circuit is used with a fluorescent lamp fixture, the capacitive reactance of the electrolytic capacitor coacts with the inductive reactance of the ballast to reduce the power to a desired level. This reduction in power can be achieved at substantially reduced cost compared to prior power-reducing circuits, because the electrolytic capacitor of the novel circuit should be less than one-third of the cost of a rolled-film capacitor such as is employed in each of the above-cited DSI and Remtec lamp substitutes. The diode adds little to the cost of the novel power-reducing circuit, being only about one-eighth that of the electrolytic capacitor. Other than the cost of the electrolytic capacitors and diodes, the only cost of making the novel power-reducing circuits involves assembling them in protective envelops (e.g., by potting them in resin in boxes). Potting is desirable both to protect the novel circuits and also to keep their connecting leads from being accidentally pulled out of the box.

Electrolytic capacitors that can be used in my novel power-reducing circuit are relatively small, e.g., one may be about 2 cm in length and 0.8 cm in diameter for use with 40 w, 120 v fluorescent lamp fixtures. Hence, in a typical fluorescent fixture, my power-reducing circuit can be easily fitted into the space where the ballast is located.

When the novel power-reducing circuit is being used as a lamp substitute with a fluorescent lamp fixture, a spare lamp can be stored in the inoperative position, or it can be mounted in the space normally occupied by the lamp being replaced, preferably adjacent one socket. By doing so, no one would accidentally attempt to place a fluorescent lamp in that position and then become disturbed by its failure to light.

When being used to reduce power without replacing a fluorescent lamp, the novel power-reducing circuit can be connected as in the Luchetta patent between the primary and secondary windings of an isolation transformer.

THE DRAWING

In the drawing, all figures of which are schematic:

DETAILED DESCRIPTION

Figure 1:
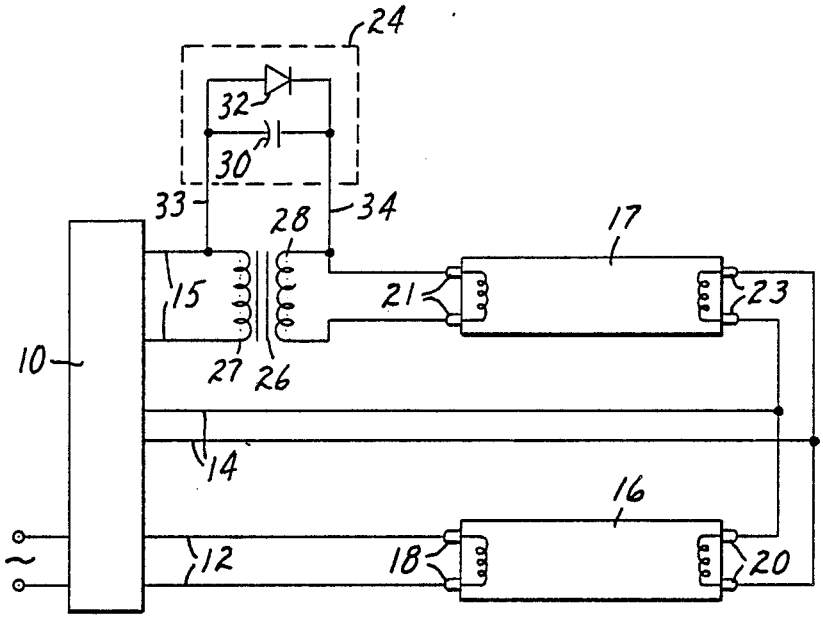
FIG. 1 shows a power-reducing circuit of my invention being used to reduce power without replacing either lamp of a 2-lamp fluorescent fixture.

In FIG. 1, the 2-lamp fluorescent fixture has an ordinary ballast 10 (like the ballast 1 of FIG. 1 of Luchetta) having first, second and third pairs of leads 12, 14 and 15, respectively, and first and second fluorescent lamps 16 and 17, respectively. The first lamp 16 has alpha and beta sets of terminals 18 and 20, respectively, and the second has alpha and beta sets of terminals 21 and 23, respectively.

The first pair of leads 12 from the ballast 10 is connected across the alpha terminals 18 for the first fluorescent lamp 16. The second pair of leads 14 is connected across the beta terminals 20 and 23 for both of the first and second fluorescent lamps 16 and 17.

A novel power-reducing circuit 24 is connected into the 2-lamp fluorescent fixture of FIG. 1 in conjunction with a small isolation transformer 26 that has primary and secondary windings 27 and 28, respectively. The power-reducing circuit consists of an electrolytic capacitor 30, a diode 32 connected in parallel with the capacitor, and leads 33 and 34 which are connected to the windings 27 and 28, respectively. The primary winding 27 is connected across the third pair of leads 15 from the ballast 10 and the secondary winding 28 is connected across the alpha terminal 21 of the second fluorescent lamp 17.

The power-reducing circuit 24 of FIG. 1 reduces power in the same manner as does the attachment of FIG. 1 of the Luchetta patent while providing the economy that its electrolytic capacitor 30 can be much less expensive that the nonpolar capacitor required by Luchetta. The power-reducing circuit of FIG. 1 can use an electrolytic capacitor, because it conducts electricity in only one direction. During opposite swings of the AC current, the electrolytic capacitor is effectively short-circuited by the diode 32.

Figure 2:
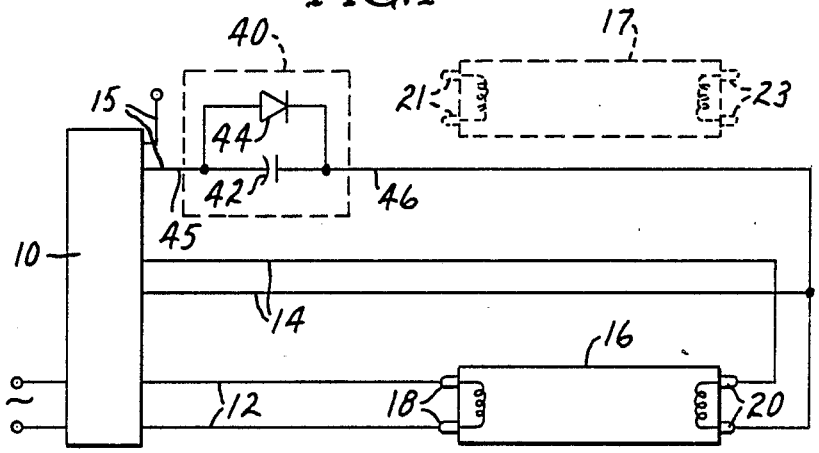
FIG. 2 shows another power-reducing circuit of my invention being used as a lamp substitute in the 2-lamp fluorescent fixture of FIG. 1.

The 2-lamp fluorescent fixture of FIG. 2 is the same as that of FIG. 1 except that the terminals 21 and 23 for the second lamp 17 have been disconnected, thus making the lamp 17 (shown in dotted lines) inoperative and no more than a spare. The novel power-reducing circuit 40 of FIG. 2 is the same as that of FIG. 1 and consists of an electrolytic capacitor 42, a diode 44 connected in parallel with the capacitor, and first and second leads 45 and 46. One of the third pair of leads 15 from the ballast 10 is connected to the first lead 45 of the power-reducing circuit 40 while the other of the leads 15 is disconnected. The second lead 46 of the power-reducing circuit 40 is connected to one of the beta terminals 20 for the first fluorescent lamp 16.

In operation, the diode 44 conducts electricity to the load during positive swings of the AC cycle, thus protecting the electrolytic capacitor 42 from current in that direction. During negative swings, the capacitor 42 conducts current to the load.

Figure 3:
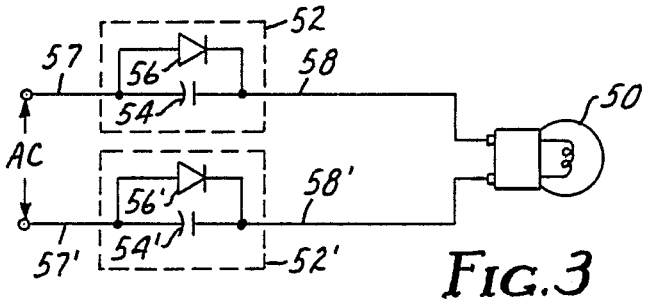
FIG. 3 shows a pair of power-reducing circuits of my invention being used with a high-intensity, low-voltage incandescent lamp.

Shown in FIG. 3 is a high-intensity, low-voltage incandescent lamp 50 and two identical power-reducing circuits 52 and 52' which respectively consist of an electrolytic capacitor 54 and 54', a diode 56 and 56' connected in parallel with the capacitor, first lead 57 and 57', and second lead 58 and 58'. The incandescent lamp 50 is connected between the second leads 58 and 58', while a source of AC current is connected between the first leads 57 and 57'.

During positive swings of the AC cycle, one of the diodes 56 and 56' is conducting while the other diode blocks the current that instead passes through the parallel capacitor. During negative swings, the exact opposite takes place.

Upon turning on current in the circuit of FIG. 3, the high-intensity, low-voltage incandescent lamp 50 gradually reaches full lighting intensity over a period of a few seconds. Hence, it is believed that the novel power-reducing circuit will protect the lamp filament from initial thermal shock and thus significantly prolong its life.

In each of FIGS. 1, 2 and 3, the amount of power reduction is determined by the capacitance of the electrolytic capacitor.

EXAMPLE 1

The power-reducing circuit of FIG. 2 has been tested at 120 v, 60 cycle AC using a 2-lamp fluorescent fixture having a General Electric 8G-1022-W ballast and replacing one of its 40 w Sylvania lamps (F40-CW). The electrolytic capacitor of the power-reducing circuit was 100 mfd, 63 v and the diode was 1N4004. The capacitor and diode were together potted with resin in a small rectangular box.

The power-reducing circuit of FIG. 1 was tested as a lamp substitute in comparison to lamp substitutes, each made in accordance with the prior art and consisting of a rolled-film capacitor without a diode. In one of those comparative lamp substitutes, a 4-mfd rolled-film capacitor was used; and in the other, the capacitor was 8 mfd, those values being selected as suggested at col. 7, line 14 of the Westphal patent. For each test, the illuminated lamp extended along the axis of a semi-cylindrical white reflector. In each test, relative light output was measured using two different light meters at a distance of about two feet, and the readings were averaged. Test results are reported in Table I.

TABLE I

| | Power (watts) | Current (amps) | Relative light output |
|---|---|---|---|
| Unmodified fixture (2 lamps) | 99 | 0.86 | 100% |
| Circuit of FIG. 1 (one lamp) | 59 | 0.54 | 50% |
| Comparative (4 mfd; one lamp) | 38 | 0.34 | 31% |
| Comparative (8 mfd; one lamp) | 44 | 0.40 | 36% |

Table I shows that the novel power-reducing circuit can bypass one lamp of a 2-lamp fluorescent fixture without any dimming of the remaining lamp. In contrast, neither of the comparative Westphal-type lamp substitutes (4-mfd and 8-mfd as suggested by Westphal) retained full output in the remaining lamp. In order to avoid dimming of the remaining lamp, the rolled-film capacitor would need to be about 20 mfd and might be so large as not to fit within the fluorescent fixture.

Table I also shows that each of the novel and the comparative power-reducing circuits is less than 100% efficient in that the percentage of power saved is slightly less than the percentage of reduction in light output. However, as noted above, the replacement of fluorescent lamps is almost always compensated in part by placing an improved light reflector behind each remaining lamp, thus keeping the level of illumination reasonably close to what the fixture was originally designed to produce.

EXAMPLE 2

The power-reducing circuit of FIG. 2 has been tested at 120 v 60 cycle AC using a 2-lamp fluorescent fixture having an Advance SM2E75-S-1-TP ballast and replacing one of its 75 w Sylvania lamps (F96T12-C-W). The electrolytic capacitor of the power-reducing circuit was 100 mfd, 63 v and the diode was 1N4004. Testing as in Example 1 is reported in Table II.

TABLE II

| | Power (watts) | Current (amps) | Relative light output |
|---|---|---|---|
| Unmodified fixture (2 lamps) | 176 | 1.50 | 100% |
| Circuit of FIG. 2 (one lamp) | 96 | 0.80 | 50% |

EXAMPLE 3

The power-reducing circuit of FIG. 1 has been tested using the same 2-lamp fluorescent fixture as in Example 1, except not removing either lamp. Tested in comparison was a power-reducing circuit made as in FIG. 1 of the Luchetta patent. Both were used with a small isolation transformer having 100 and 180 turns in the primary and secondary windings, respectively.

The Luchetta circuit employed a 5-mfd, rolled-film, nonpolar capacitor. The novel power-reducing circuit employed a 5-mfd electrolytic capacitor and its diode was 1N1004. Test results are reported in Table III.

TABLE III

| | Power (watts) | Current (amps) | Relative light output |
|---|---|---|---|
| Unmodified fixture (2 lamps) | 99 | 0.86 | 100% |
| Circuit of FIG. 1 (2 lamps) | 76 | 0.66 | 66% |
| Luchetta-type (2 lamps) | 76 | 0.66 | 66% |

Although the same efficiency of power reduction was attained in comparison to the Luchetta-type circuit, the power-reducing circuit of the invention affords a substantial reduction in cost because of the significantly higher cost of a nonpolar capacitor required in the Luchetta-type circuit.

EXAMPLE 4

FIG. 3 was constructed to be used at 120v, 60 cycles AC as follows:

| | |
|---|---|
| electrolytic capacitors 54 and 54' | 100 mfd, 250 v |
| diodes 56 and 56' | 1N4004 |
| high-intensity incandescent lamp 50 | 30 w, 13.8 v |

The two power-reducing circuits were potted together in resin in a rectangular box that was 9×6×4 cm in outside dimensions, and their leads were connected to the lamp as shown in FIG. 3.

To provide a comparison, the same incandescent lamp was placed in a commercial lamp fixture which included a transformer.

In using each of the circuitry of Example 4 and the comparative fixture, the line voltage was adjusted to drive the lamp at 2.17 amp to provide the same brightness, as verified with a photocell at a distance of 5 inches. The input wattage using the circuitry of Example 4 was 30 watts compared to 33 watts when using the commercial fixture.

When the circuitry of Example 4 was connected to the AC source, it required about 1.5 seconds for it to reach an indication of full brightness on a light meter. As noted above, this gradual brightening should protect the lamp filament from initial thermal shock and thus significantly prolong its life.

I claim:

1. Power-reducing circuit for a fluorescent lighting fixture or a high-intensity, low-voltage incandescent lamp, which circuit consists essentially of an electrolytic capacitor, a diode connected in parallel with the capacitor, and connecting leads.

2. Power-reducing circuit as defined in claim 1 that is potted in resin in a box.

3. Fluorescent-lamp fixture comprising circuitry including a power-reducing circuit consisting essentially of an electrolytic capacitor, a diode connected in parallel with the capacitor, and connecting leads.

4. Fluorescent-lamp fixture as defined in claim 3 wherein said power-reducing circuit has been wired into the circuitry of the fixture to replace a fluorescent lamp.

5. Fluorescent-lamp fixture as defined in claim 4 and having a ballast with three pairs of leads and terminals for two fluorescent lamps, one of which can be removed while the other can be lighted, wherein two of said three pairs of ballast leads are connected to opposite sets of terminals for one of the lamps, and the leads of the power-reducing circuit are connected between one of the third pair of the ballast leads and one of the terminals for said one lamp.

6. Fluorescent-lamp fixture as defined in claim 5 wherein the electrolytic capacitor is selected to have a capacitance to permit the remaining lamp to be illuminated at full brightness.

7. Fluorescent-lamp fixture as defined in claim 3 and having terminals for two fluorescent lamps plus circuitry comprising a first pair of said ballast leads connected across an alpha set of terminals for a first of the fluorescent lamps, a second pair of ballast leads connected across beta sets of terminals for each lamp, an isolation transformer having a primary winding connected across a third pair of ballast leads and a secondary winding connected across the alpha set of terminals of the second of the fluorescent lamps, and each lead of said power-reducing circuit is connected to one of said windings.

8. Fluorescent-lamp fixture as defined in claim 3, the power-reducing circuit of which is potted in resin.

9. An AC lamp fixture for a high-intensity, low-voltage incandescent lamp, which fixture comprises transformerless circuitry including a pair of power-reducing circuits, each consisting essentially of an electrolytic capacitor, a diode connected in parallel with the capacitor, and connecting leads.

10. A lamp fixture as defined in claim 9 wherein each of the electrolytic capacitors is selected to have a capacitance to reduce the output voltage of the circuitry to the rated voltage of the incandescent lamp.

11. Power-reducing circuit for a fluorescent lighting fixture or a high-intensity, low-voltage incandescent lamp, which circuit consists of an electrolytic capacitor, a diode connected in parallel with the capacitor, and connecting leads.

* * * * *